US011450491B2

(12) United States Patent
Foshag et al.

(10) Patent No.: US 11,450,491 B2
(45) Date of Patent: Sep. 20, 2022

(54) PROTECTIVE COLLAR FOR ACUTATING ELEMENTS, IN PARTICULAR SWITCHES

(71) Applicant: Eaton Intelligent Power Limited, Dublin (IE)

(72) Inventors: Lisa Bettina Foshag, Hirschhorn (DE); Achim Jautz, Limbach (DE); Toni Christian Ott, Neckargemünd (DE)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 17/281,720

(22) PCT Filed: Oct. 1, 2019

(86) PCT No.: PCT/EP2019/025328
§ 371 (c)(1),
(2) Date: Mar. 31, 2021

(87) PCT Pub. No.: WO2020/069775
PCT Pub. Date: Apr. 9, 2020

(65) Prior Publication Data

US 2021/0391126 A1 Dec. 16, 2021

(30) Foreign Application Priority Data

Oct. 1, 2018 (DE) ..... 102018216879.2

(51) Int. Cl.
*H01H 9/28* (2006.01)
*H01H 3/02* (2006.01)

(52) U.S. Cl.
CPC ..... *H01H 9/287* (2013.01); *H01H 3/022* (2013.01)

(58) Field of Classification Search
CPC ..... H01H 3/022; H01H 9/287; H01H 13/04; B60R 21/09
USPC ..... 200/6 A, 293
See application file for complete search history.

(56) References Cited

U.S. PATENT DOCUMENTS 10,446,337 B2 * 10/2019 Wu ..... H01R 13/514

FOREIGN PATENT DOCUMENTS

| | | | | |
|---|---|---|---|---|
| EP | 1248274 A2 | | 10/2002 | |
| EP | 2040274 | * | 3/2009 | ..... B60R 16/02 |
| EP | 2040274 A1 | | 3/2009 | |
| WO | 2015/083334 A1 | | 6/2015 | |

OTHER PUBLICATIONS

International Search Report for PCT/EP2019/025328, dated Dec. 17, 2019, 2 pages, Rijswijk Netherlands.

* cited by examiner

*Primary Examiner* — Renee S Luebke
*Assistant Examiner* — Iman Malakooti
(74) *Attorney, Agent, or Firm* — Stinson LLP

(57) ABSTRACT

The invention relates to a protective collar for at least partially receiving an actuating element which extends through a housing of a control unit and projects beyond an outer side of the housing. The protective collar has a base with a through-opening and a first circumferential collar radially spaced from the through-opening and extending from an upper surface of the base in a first direction. The first collar has at least two cut-outs such that the first collar forms at least two wings, wherein at least one of the wings has at least one predetermined breaking point extending in the circumferential direction.

19 Claims, 6 Drawing Sheets

PROTECTIVE COLLAR FOR ACUTATING ELEMENTS, IN PARTICULAR SWITCHES

CROSS-REFERENCE TO RELATED APPLICATION

This application is a 371 of international PCT Serial No. PCT/EP2019/025328, filed Oct. 1, 2019, which claims the benefit of German Serial No. 102018216879.2, filed Oct. 1, 2018, the entire contents of which are incorporated herein by reference.

FIELD

The present disclosure relates to a protective collar for actuating elements, such as switches. The protective collar is suitable, in particular, for emergency stop switches, which are also referred to as emergency stop, emergency power-off switches or emergency power-off or the like.

BACKGROUND

In diverse fields, there are diverse actuating elements which, if they project relative to a surface to which they are attached, need to be protected against inadvertent actuation or, possibly, against damaging lateral loads. A particular class of such actuating elements are emergency stop switches, which are usually easily visible and easily accessible on or in the vicinity of machines and installations and by their actuation serve to put said machines and installations into a safe state. This can be done in different ways, as is known in the art. This also partly results in the different designations, although these are not always used uniformly. An emergency power-off switch thus typically effects a disconnection of the power supply to an associated machine or installation, while an emergency stop switch is normally able to stop moving elements of the machine or installation without necessarily interrupting the power supply. There are also mixed forms in which the energy supply is interrupted only to parts of the machine or installation. In the following description, the term emergency stop switch will be used throughout, regardless of which function is triggered by the particular actuation.

The emergency stop switch usually takes the form of an impact button, which can be moved linearly between an On position and an Off or Stop position. The switches are usually designed such that after actuation they cannot be inadvertently returned to an active state. For example, emergency stop switches with an integrated lock are known which, after actuation, can only be brought into the On position with a key. Alternative emergency stop switches can be brought into the On position, for example, by a simple pulling or a combined turning and pulling-out of the impact button. Even in the case of those emergency stop switches that have no integrated lock, it may be advisable to provide an additional secured locking in the Stop position, so that only specific individuals, for example those with a key, can release the impact button.

The switches can also have a preloading in the Stop position, so that after an initial first actuation, the switches automatically execute their full stroke into the Stop position. As a result of their freely accessible positioning, the emergency stop switches can easily be actuated erroneously or damaged. Incorrect actuations lead to undesired interruptions in operations while damage to the emergency stop switch can impair the functionality of the switch and thus the safety of the machine or installation. Of course, such problems can also occur with other exposed actuating elements, not only with emergency stop switches.

It is therefore known, for example, to provide a protective collar for the emergency stop switch which at least partially surrounds an impact button as actuating element and, in particular, protects against lateral loads and in some cases also against inadvertent actuations. Such protective collars must be designed in such a way that they do not impair actuation of the emergency stop switch. In particular, protective collars should be designed in such a way that actuation of the emergency stop switch with the palm is possible without any risk of injury to the operator. In addition, a very wide variety of further requirements applies to emergency stop switches and their use, depending on the field of application, such as, for example, regular impact tests in which the functionality of the emergency stop switch is tested using a specific impact force, or also requirements with regard to possible static charging of the switches.

In the case of recurrent impact tests, a protective collar can in part reduce the load on the emergency stop switch, but at the same time an increased load can be transmitted to a switch housing via the protective collar, which can lead to damage thereof. In addition, a protective collar generally also increases the available surface area for building up static charges, which can lead to problems depending on the field of application.

SUMMARY

The present invention is aimed at providing an improved protective collar for actuating elements, such as switches, in particular emergency stop switches.

A protective collar according to claim 1 is provided. Further embodiments of the invention result, inter alia, from the dependent claims.

In particular, a protective collar is disclosed for at least partially receiving an actuating element extending through a housing of a control device and projecting beyond an outer side of the housing, the protective collar comprising the following: a base having a through-opening and a first circumferential collar radially spaced from the through-opening and extending from an upper side of the base in a first direction. The first collar has at least two cut-outs such that the first collar forms at least two wings, wherein at least one of the wings has at least one predetermined breaking point extending in the circumferential direction. Such a protective collar can make it possible for the wings to deflect or break in the region of the predetermined breaking point, as a result of which forces acting on the protective collar are not simply passed on through the protective collar.

In one embodiment, two predetermined breaking points are formed by a slot extending circumferentially over at least 40% of the width of the wing, wherein the slot does not extend as far as the cut-outs so that one predetermined breaking point is formed in each case in the region between the ends of the slot and the cut-outs. Alternatively, a plurality of predetermined breaking points may also be formed by a series of slots or cut-outs arranged linearly in a circumferential direction of the wing and extending over at least 40% of the width of the wing.

In one embodiment, the slot or the series of slots or cut-outs is formed centrally in the circumferential direction of the wing and preferably extends over at least 70% of the width of the wing. Furthermore, preferably at least two wings can have at least one corresponding predetermined breaking point for a uniform distribution of forces in the protective collar. In order to allow additional flexion of the wings, the first collar extends, in one embodiment, in an inclined manner away from an upper side of the base, so that a space formed between the wings widens away from the base. In this case, the first collar can extend at an angle between 5° and 15° to a plane of the base. In particular, the first collar can have a round shape.

In order to be able to accommodate a securing element, in one embodiment a through-opening is formed in each case in each of two opposing wings and is aligned with the through-opening in the opposite wing. In this case, the through-opening is preferably arranged between the slot and a free end of the wing. On at least one wing the protective collar can also have a mounting eyelet for the securing element.

In a further alternative, the protective collar has a second collar which is arranged radially inside the first collar, wherein the second collar surrounds and radially delimits the through-opening. The second collar preferably has a height which is less than the height of the wings of the first collar and which is greater than the height of the first collar at the lowest point of the cut-outs.

On the inner circumference of the through-opening the protective collar can have a step widening towards the underside, which can serve, for example, for partially receiving and/or fastening a sealing element. In a further embodiment, a third circumferential collar is provided which extends from the underside of the base and forms, below the base, a receiving space which preferably has a diameter greater than the through-opening. Such a receiving space formed by a third collar can also receive parts of the actuating element even below the base, if this is required.

In an alternative, the third collar has structures on the inner circumference which are suitable for working together with structures on the actuating element or a housing for the actuating element in order to prevent the protective collar from rotating relative to the actuating element or the housing.

In a further embodiment, structures for making a clamping connection to elements of the actuating element are provided on the inner circumference of the third collar, wherein preferably a plurality of projections evenly spaced apart in the circumferential direction of the inner circumference of the third collar and extending inwardly is provided.

BRIEF DESCRIPTION OF THE DRAWINGS

The invention will be explained in more detail below with reference to the drawings. The drawings show.

DETAILED DESCRIPTION

Figure 1:
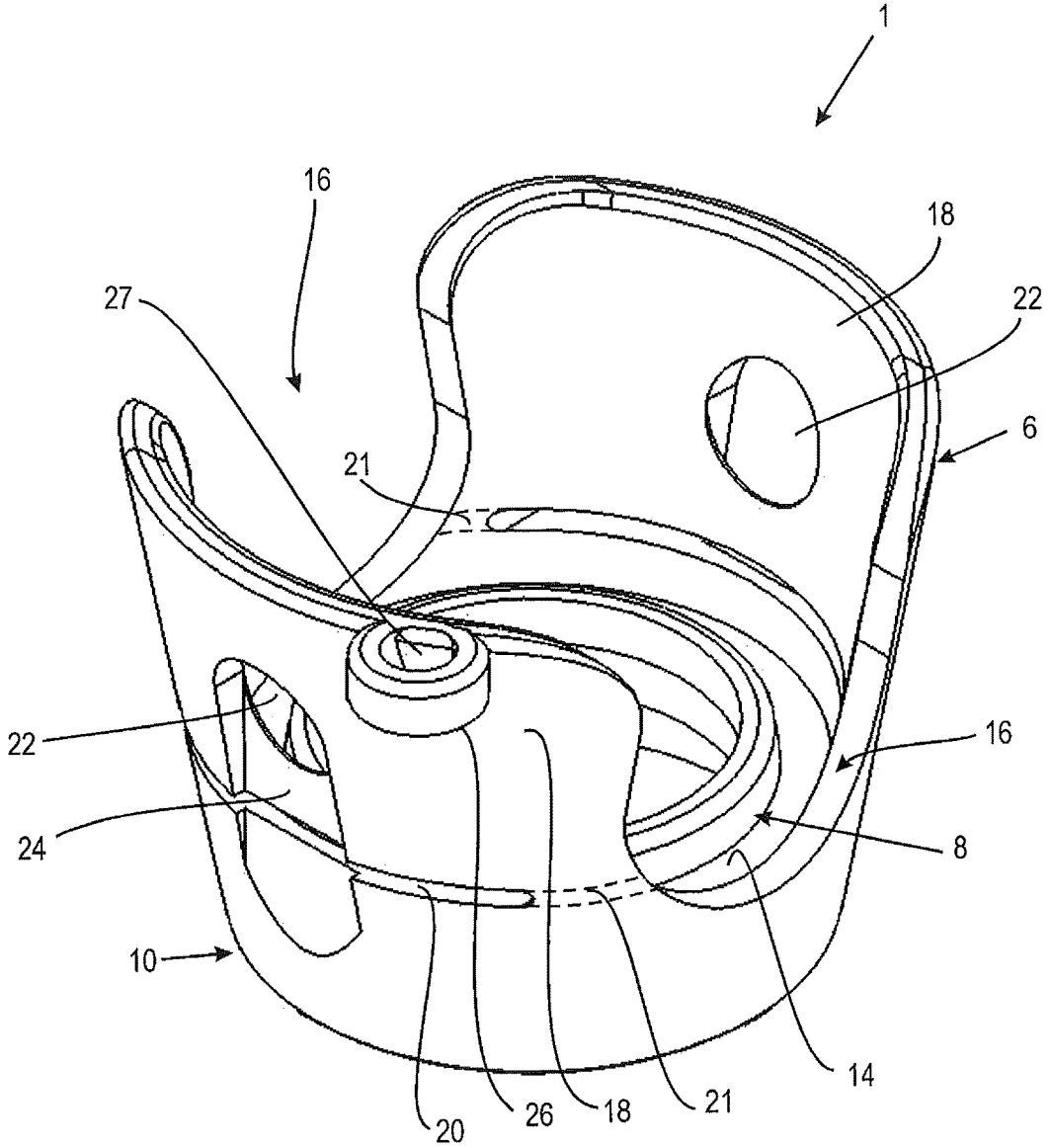
FIG. 1 a schematic perspective plan view of a protective collar for an actuating element such as an emergency stop switch.

Location and direction indications used in the description below refer to the representation in the drawings and should therefore not be regarded as limiting. They can, however, also relate to a preferred final arrangement.

Figure 4:
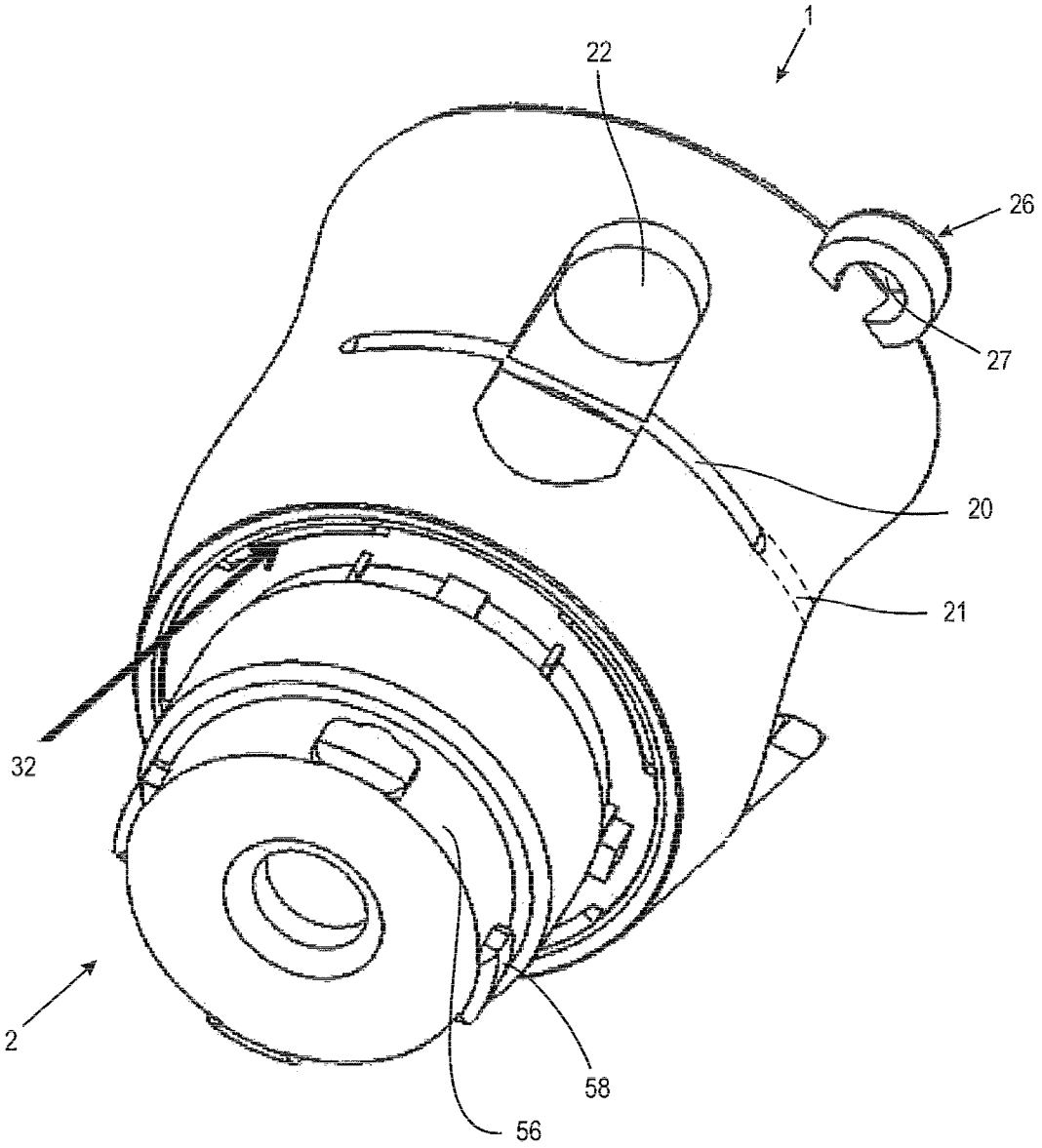
FIG. 4 a schematic perspective view from below of the protective collar shown in FIG. 1 with an emergency stop switch installed therein that is in an On position.
Figure 5:
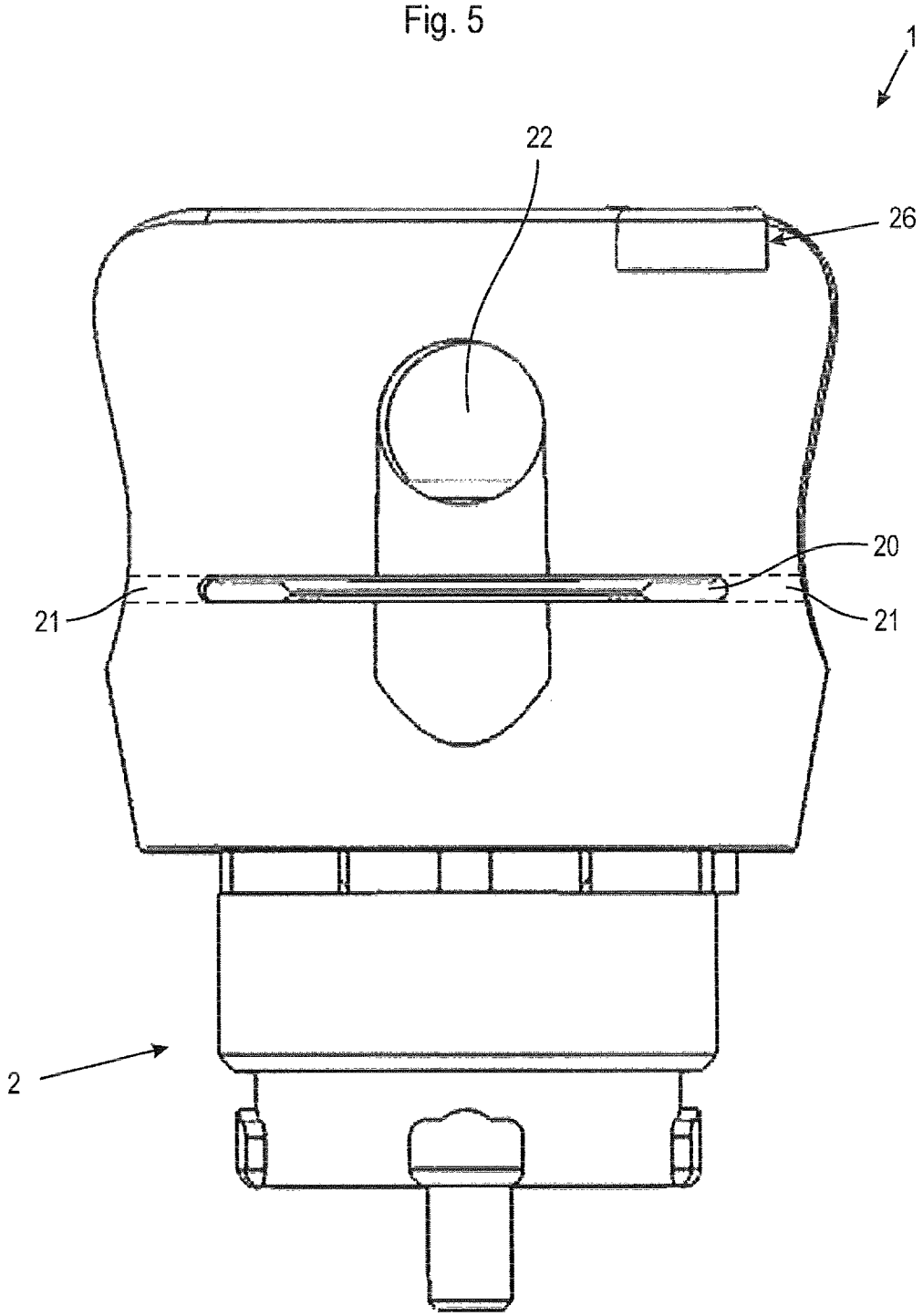
FIG. 5 a schematic side view of the protective collar with an emergency stop switch installed therein that is in a Stop position.
Figure 6:
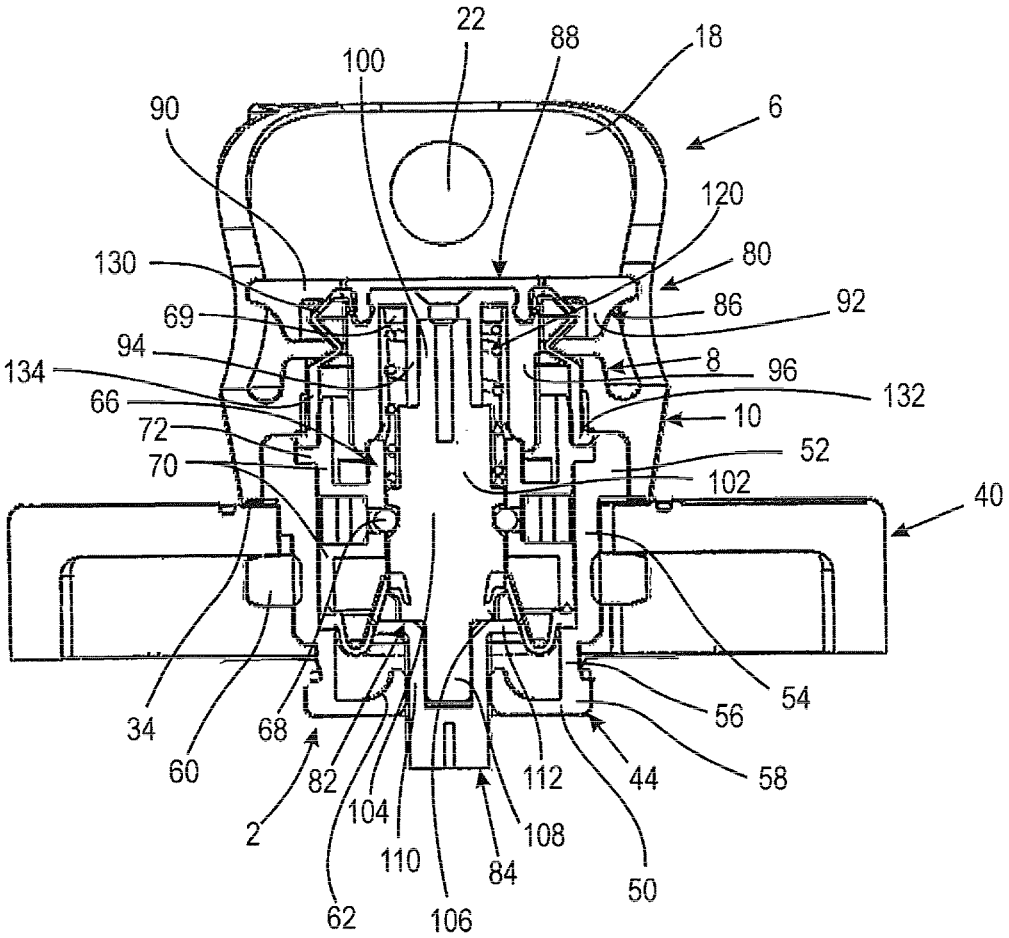
FIG. 6 a schematic sectional view through the protective collar shown in FIG. 1 with an emergency stop switch installed therein that is in a Stop position.

The figures show different views of a protective collar 1 for an actuating element in the form of an emergency stop switch 2, which in FIGS. 4 to 6 is only shown schematically. Although the protective collar is described below specifically in combination with an actuating element taking the form of an emergency stop switch, the protective collar can also be used for other actuating elements having a similar construction, but being used without an emergency stop function.

The protective collar 1 is substantially formed by a base 4, a first collar 6 and also a second collar 8 and a third collar 10, the second and third collars being optional. The protective collar 1 is formed in one piece and the transitions between the aforementioned parts are therefore fluid. The protective collar is made, for example, of a thermoplastic plastic material or other suitable material, for example in an injection-molding process or by another suitable method.

Figure 2:
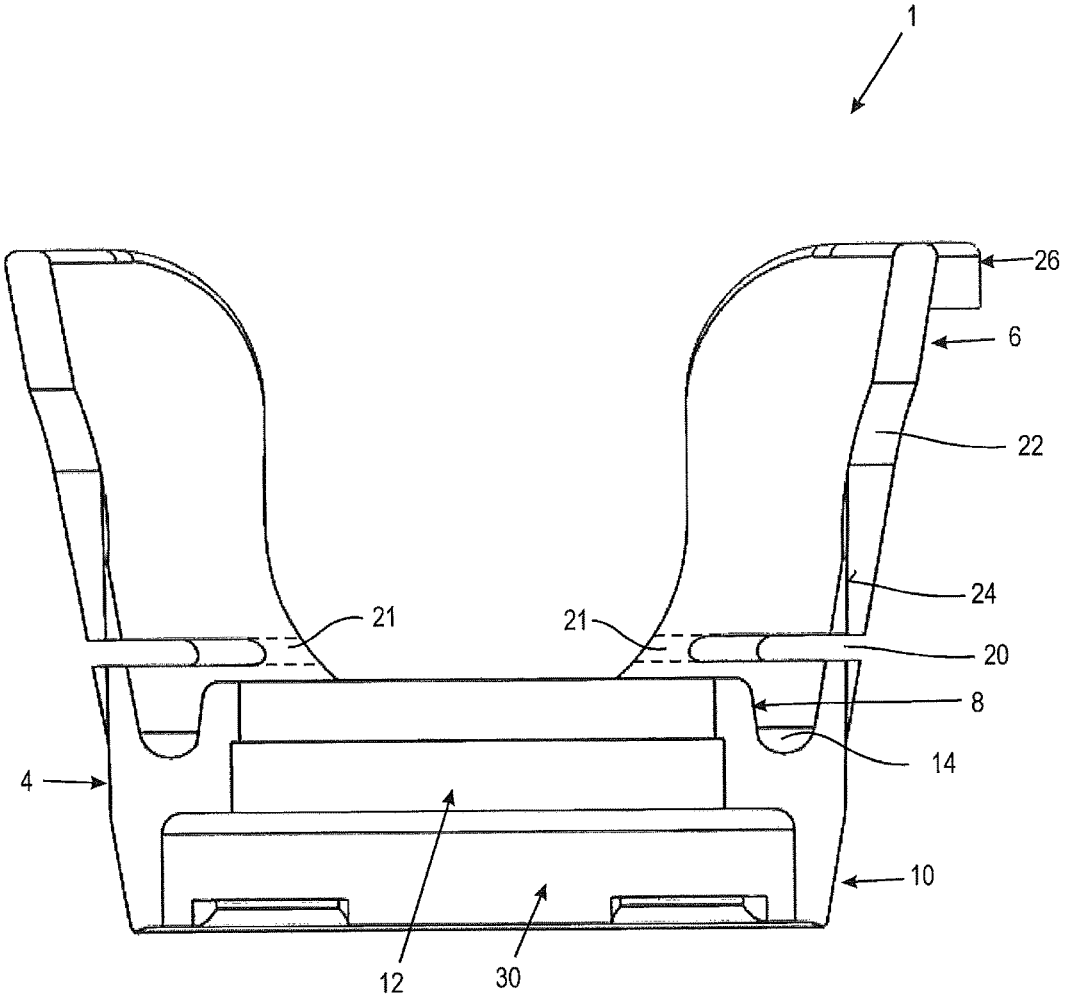
FIG. 2 a schematic sectional view through the protective collar shown in FIG. 1.
Figure 3:
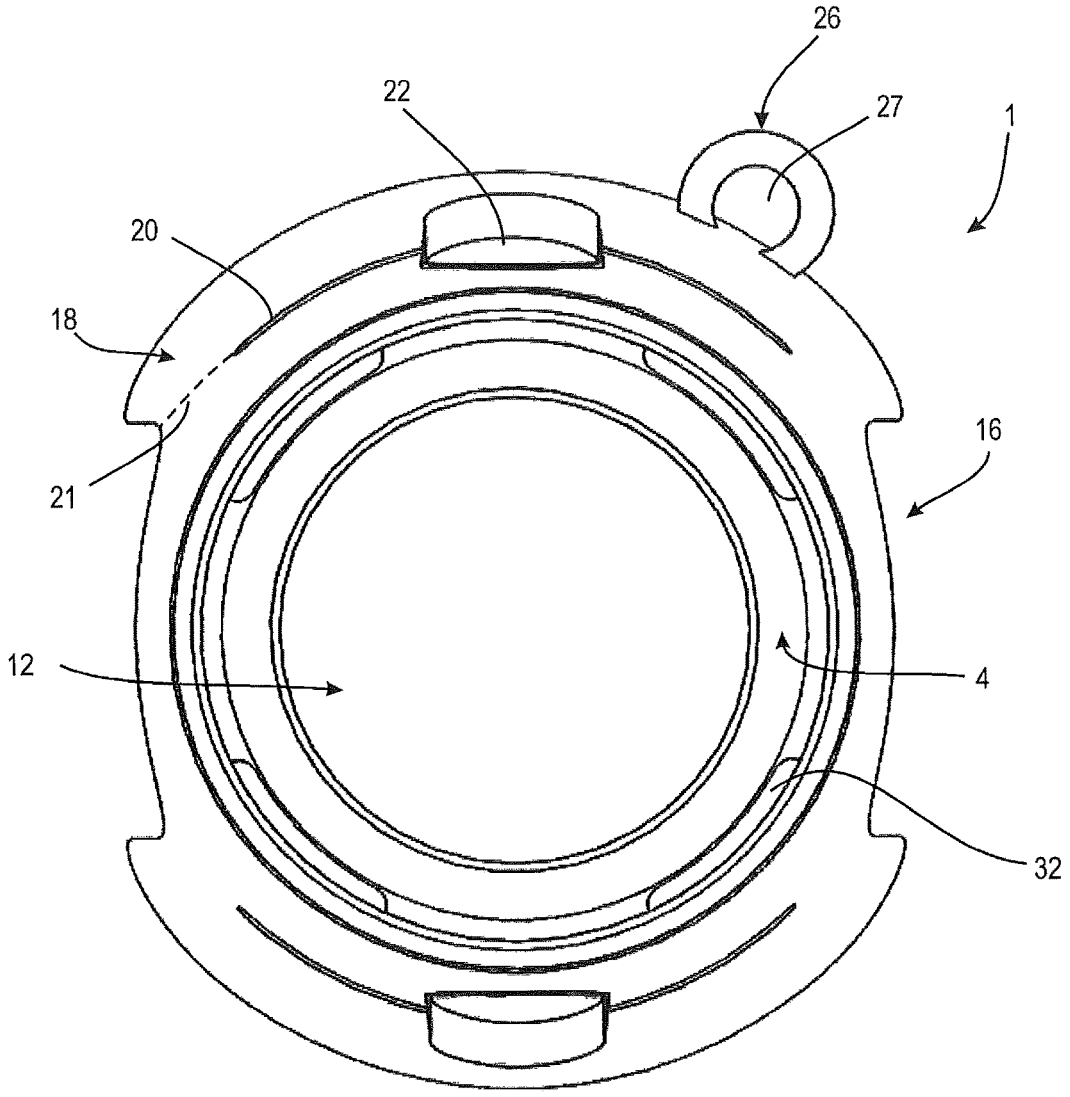
FIG. 3 a schematic view from below of the protective collar shown in FIG. 1.

An annular part of the protective collar with a horizontal orientation as shown in FIG. 2 is regarded as the base 4. Of course, the protective collar 1 can be used in a wide variety of orientations, the horizontal orientation therefore being introduced only for the purpose of describing the arrangement of the different elements relative to one another. The base 4 has a stepped, downwardly widening central opening 12, as best seen in FIG. 2. As will be explained in more detail below, the central opening 12 serves for passing parts of the emergency stop switch 2 through, as is known in the art. A circumferential groove 14 with a rounded bottom is formed in an upper side of the base 4.

The first collar 6 extends upwardly at the outer edge of the upper side of the base (as shown in FIG. 2). As is best shown in FIG. 2, the first collar 6 extends at an angle to the vertical such that a space widening away from the base 4 is at least partially enclosed by the first collar 6. The first collar is preferably inclined between 5° and 15° to the vertical or, in other words, the first collar 6 is inclined by 75° to 85° to a plane defined by the base 4.

The first collar 6 has a first region directly adjacent to the base 4 which is fully circumferential and a second region in which the first collar 6 is interrupted by two cut-outs 16 and forms two wings 18. Passages (not shown) may be provided in the first region of the first collar 6 and/or base 4 in order to be able, if appropriate, to discharge to the outer circumference of the protective collar 1 liquid accumulations occurring in the region of the groove 14.

The cut-outs 16 are rounded in form, namely in such a way that in the direction away from the base 4 the wings 18 initially become narrower, but then become broader again before once again becoming narrower towards the free end (away from the base 4). The wings 18 seen from above each have a round shape which substantially follows the circumferential shape of the base 4. Here, the width is considered to be the circumferential length of the wing in the horizontal plane (in the orientation shown in FIG. 2) or in a plane parallel to the planes of the base 4.

The wings 18 each have a height measured from the height of the base, which is greater than a stroke of the emergency stop switch 2, as will be explained in more detail below. Formed in each of the wings 18 is a slot 20 extending substantially parallel to the plane of the base 4 and extending completely from an inner side (side facing the other wing) to an outer side of the wing. In the region between the ends of the slot 20 and the cut-outs, the slot 20 forms predetermined breaking points which extend in the circumferential direction and are indicated by dashed lines at 21. The predetermined breaking points 21 are formed because in the circumferential direction of the wing 18 at the height of the slot there is less material above and below it. Instead of a single slot 20, it is also possible to provide a series of slots or cut-outs, whereby a plurality of predetermined breaking points can be formed. Additionally or alternatively to the slot or the series of slots or cut-outs, at least one groove extending in the circumferential direction of the wing can be provided, said groove being provided on the inner side and/or on the outer side of the wing. In particular, if the at least one groove is formed at the height of the slot 20 or the series of slots or cut-outs in the remaining regions of the wing 18, a weakening of the wing 18 in the region of the groove can thereby be formed in order to form the at least one predetermined breaking point. The slot 20, the series of slots or cut-outs and/or the groove preferably extends over at least 40% (preferably between 60% and 90%) of the width of the wing 18 at this height and is at a distance from the cut-outs 16. In particular, the slot 20 or the series of slots or cut-outs can in each case lie centrally between the cut-outs 16. Alternatively, however, slots extending from the cut outs 16 to the center of the wing may also be provided in order to form a single predetermined breaking point centrally between the slots. The slot 20 or the series of slots or cut-outs is formed at a height above the first—fully circumferential—region of the first collar 6. The slot 20 or the series of slots or cut-outs is preferably further formed at a height below half the height of the respective wing 18. The slot 20 or the series of slots or cut-outs is formed in such a way that in each case they allow a certain flexion of the wing 18 in the direction of the base 4, the respective regions between the slot 20 and the cut-outs 16 serving as predetermined breaking points 21, in order to prevent an excessive transmission of force through the protective collar onto an underlying element, as will be explained in more detail below. Corresponding predetermined breaking points can also be formed or supported by a series of slots or cut-outs or by a groove extending in the circumferential direction.

Furthermore, above the corresponding slot 20 a circular through-opening 22 is formed in each wing which is dimensioned for a latching element (not shown) to pass therethrough, as will be explained in more detail below. The through-openings 22 of the wings 18 are each arranged centrally between the cut-outs 16 and aligned with each other, so that the latching element can be guided in a straight line through the two through-openings 22. The through-openings 22 are formed at a height which is above half the height of the respective wing 18, wherein it is assumed here that the height of the through-openings 22 is in each case defined by their center point. Below the through-openings 22, deviating from the other inclination of the first collar 6, the outer side of the first collar 6 is formed by a wall section 24 extending essentially vertically (perpendicular to the plane of the base). The inner side of the first collar 6 here runs as normal, however, so that in this region the wall thickness of the first collar 6 tapers away from the base 4 in the direction of the through-opening 22.

An annular receiving element 26 is provided on one of the wings 18. The receiving element 26 is formed on the outer side of the wing 18 adjacent to an upper edge and has a horizontal orientation. An opening 27 in the receiving element 26 thus extends in the vertical direction. The receiving element 26 is arranged offset with respect to the through-opening 22, i.e., not centrally between the cut-outs. The opening 27 in the receiving element 26 is dimensioned for passage of the latching element, not shown, such as a securing bolt, a shackle of a shackle lock or the like.

The second collar 8 lies radially inside the first collar and likewise extends upwards from the upper side of the base (FIG. 2). As best shown in FIG. 2, the second collar 8 forms an extension of the central opening 12 extending through the base 4. Consequently, the second collar 12 is formed directly at the innermost edge of the base 4 and even projects radially inward over the inner edge, so that a step is formed at the transition between the base 4 and the second collar 8. Due to this step, the central opening 12 has an upper region of smaller diameter (formed by the second collar 8) and a lower region of a larger diameter (formed by the base 4).

The second collar 8 has an upper surface that lies vertically between the lowest point of the cut-outs 16 and the slots 20 in the wings 18.

The third collar 10 extends downwardly at the outer edge of the underside of the base (FIG. 2). As best shown in FIG. 2, an outer wall of the third collar 10 extends at an angle to the vertical such that an inner circumference of the third collar tapers away from the base 4. However, an inner wall of the third collar 10 extends perpendicular to the underside of the base such that the inner wall of the third collar defines a cylindrical receiving space 30 below the base. The transition between the inner wall of the third collar 10 and the base 4 is rounded, as can be seen in FIG. 2.

A plurality of inwardly projecting projections 32 (here four) are provided on the inner wall at the lower end of the third collar 10. The projections 32 are equally spaced circumferentially and each have equal dimensions in the circumferential direction. The projections serve as latching hooks in order to fasten the protective collar 1 to the emergency stop switch 2 and can furthermore prevent twisting between protective collar and emergency stop switch.

The underside of the third collar 10 is not flat but has, adjacent to the inner wall, a surface which is set back with respect to the surface directly adjacent to the outer wall. The transition between the two surfaces is formed by a bevel, and the annular space formed thereby is suitable for receiving an annular seal 34 (indicated in FIG. 6), as the person skilled in the art can recognize. By contouring the underside of the third collar 10, a corresponding seal can be centered with respect to the protective collar 1. By taking the outer wall further downward than the inner wall, lateral displacement of the seal 34 in the assembled state can be restricted or prevented.

An exemplary construction of an actuating element in the form of an emergency stop switch 2, for which the protective collar 1 is suitable, will now be described in more detail below. In this case, the emergency stop function of the actuating element is not important, since the protective collar can also be used advantageously in combination with other actuating elements. The emergency stop switch 2 can best be seen in the sectional representation in FIG. 6 in which a housing 40 of a control unit (not shown) is also indicated, to which the emergency stop switch 2 with protective collar 1 is attached. In this case, the housing has a through-opening through which parts of the emergency stop switch 2 extend, as is known in the art.

The emergency stop switch 2 essentially consists of a fastening unit 44, a guiding and latching unit 46 and an actuating element 48.

The fastening unit 48 consists of a substantially hollow-cylindrical main body 50 with varying inner and outer diameters. The outer wall of the main body 50 thus has in an upper region 52 thereof an outer diameter that is matched to the inner diameter of the cylindrical receiving space 30 of the protective collar 1 (in the region of the third collar) in order to be snugly received therein. The upper region 52 of the main body 50 is structured hereby such that it can latch with the projections 32 of the third collar 10 of the protective collar 1 in order to fasten these two to each other.

Adjacent to the upper region 52 there is a central region 54 of the main body having an outer diameter that is smaller than the outer diameter of the upper region 52. A step is thus formed between the upper region 52 and the central region 54. A thread is at least partially provided on the outer circumference of the central region.

The central region 54 also adjoins a lower region 56, which in turn has a smaller outer diameter than the central region 54. At the lower end of the lower region 56, a plurality of projections 58 is provided, which are equidistantly spaced in the circumferential direction of the lower region.

While the outer diameter of the upper region 52 is larger than the through-opening in the housing 40, the outer diameter of the central region 54 is smaller than the through-opening in the housing 40. Consequently, the main body 50 can be guided through the through-opening from above in such a way that it rests on the housing 40 with the step formed between the upper region 52 and the central region 54. A nut 60 screwed onto the thread of the central region from the inside of the housing 40 allows the main body 50 to be securely fastened to the housing, as indicated in FIG. 6. As a result of the latching of the main body with the protective collar 1, the latter can also be securely fastened to the housing via the main body. The central region 54 of the main body 50 further has an outwardly projecting nose which is matched to a corresponding groove in the through-opening in the housing 40 so that the main body can only be guided through the through-opening of the housing 40 in a specific rotational position and is thus also accommodated in a rotationally secure manner therein.

An inner wall of the main body 50 has a step in the upper region 52 such that the inner circumference of the upper region widens upwardly. The inner wall of the main body 50 has a further step at the transition between the central region 54 and the lower region 56 such that the inner circumference widens upwardly. Also provided at the lower end of the main body 50 is a circumferential inwardly extending flange 62 which leaves a central opening free.

The guiding and latching unit 46 is at least partially received in the main body 50 of the fastening unit 48 and has a rather complex structure, only the most important elements of which will be explained in more detail here. Firstly, the guiding and latching unit 46 forms a central, vertically extending hollow-cylindrical guide section 66 which forms a guide surface in the interior. A plurality of openings (for example four) is formed in this guide surface at a certain height, in each of which a ball element 68 is accommodated. The ball elements 68 are each accommodated in the openings in such a way that they can move perpendicular to the guide surface, namely between a first position in which they project inwardly beyond the guide surface and a second position in which they do not project beyond the guide surface. The ball elements 68 can each be preloaded into the first position via a preloading element not shown. The hollow-cylindrical guide section 66 has in an upper section a plurality of circumferentially equally spaced, axially extending slots (four, for example).

The guiding and latching unit 46 further includes an annular counter-bearing element 69 provided at an upper end of the central, vertically extending, hollow-cylindrical guide section 66 and may be formed, for example, as an inwardly extending flange.

The guiding and latching unit 46 forms an outer cylindrical region 70 that is snugly received in the central region 54 (and partially in the upper region 52) of the main body 50 of the fastening unit 48 and extends upwardly beyond the upper region 52 of the main body 50. The uppermost section of the outer cylindrical region 70 extends into the central opening 12 of the protective collar 1. In the region of the step in the inner wall of the upper region 52 of the main body 50, the outer cylindrical region 70 has a radially outwardly extending flange 72 which rests on the step.

The actuating element 48 essentially consists of a head unit 80, a shaft section 82 and a transmission element 84.

The head unit 80 consists of a main body 86 and a cover 88. The main body 86 has an upper plate element 90 having a central recess in its upper side, which is dimensioned for receiving the cover 88. Provided on the underside of the plate element are an outer circumferential flange 92, an inner circumferential flange 94, as well as a plurality of guide elements 96, each extending substantially vertically downwards.

The flange 92 is radially inwardly offset with respect to a circumference of the plate element 90 and has a rounded outer circumference tapering away from the plate element. The inner circumference forms a vertically extending cylindrical surface.

The inner flange 94 forms a vertically extending hollow cylinder having a cylindrical receiving space that is open at the bottom and bounded at the top by the plate element 90. Provided in the plate element 90 in the region of the recess is a vertical through-opening which opens into the receiving space of the inner flange 94 and is suitable for the passage of a fastening element, such as a screw.

The plurality of guide elements 96 is disposed on the underside of the plate element 90 between the outer flange 92 and the inner flange 94. The number of guide elements 96 corresponds to the number of slots in the upper region of the hollow-cylindrical guide section 66 and the guide elements 96 are aligned with the corresponding slots. A lower edge of the guide elements 96 may limit downward movement of the head unit 80, as shown in FIG. 6.

The shaft section 82 of the actuating element is formed by a solid, cylindrical shaft section 82 having a contoured outer circumferential surface. An upper region 100 of the shaft section 82 has a first outer circumference suitable for receiving, in particular for snugly receiving, in the receiving space of the inner flange 94. The upper region 100 is further provided with an axially extending opening, in particular a threaded opening for receiving a fastening element, via which the shaft section 82 can be fastened to the plate element 90 of the head unit, as is indicated in FIG. 6.

Adjacent to the upper region 100 is an upper central region 102 of the shaft section with an enlarged outer circumference so as to be formed between the upper region 100 and the upper central region 102. This can come into abutment against an underside of the inner flange 94, as shown in FIG. 6. The outer circumference of the upper central region 102 is less than the inner circumference of the hollow-cylindrical guide section 66 of the guiding and latching unit 46.

A central region 104 of the shaft section 82 abuts in turn on the upper central region with an outer circumference that is enlarged relative to the upper central region 102. Consequently, once again, a step is formed at the transition between the upper central region 102 and the central region 104. The outer circumference of the central region 104 is matched to the inner circumference of the hollow-cylindrical guide section 66 so as to be snugly received and guided therein. In particular, an axial guide for the shaft section 82 is thereby formed. In the outer circumference, a circumferential groove is formed at a predetermined height and is dimensioned such that it can receive the ball elements 68, as shown in FIG. 6. In this position, the shaft section 82 is locked in place by the ball elements 68. The groove is contoured such that the ball elements 68 are pushed out of the groove and into the openings in the hollow-cylindrical guide section 66. The latching can thus be overcome by a corresponding tensile force, which, however, is significantly higher than if no corresponding latching were provided.

A lower central region 106 having an outer circumference that is reduced in size relative to the central region 104 abuts onto the central region 104 of the shaft section 82. A reverse step is thus now formed at the transition between the central region 104 and the lower central region 106. The outer circumference of the lower central region 106 corresponds substantially to the outer circumference formed by the bottom of the groove in the central region 104.

When the actuating element 48 is not in the Stop position, as shown in FIG. 6, the head unit 80 is moved upwardly with the shaft section 82 until the ball elements 68 bear against the reduced outer circumference in the region of the lower central region 106, thereby again deploying a certain latching action. In this case, the ball elements 68 counteract a free downward movement of the shaft section 82. However, a corresponding movement is released above a certain pressing force.

A lower region 108 of the shaft section 82 also abuts onto the lower central region, which in turn has an even further reduced outer circumference, so that a downwardly facing step is formed at the transition. The lower region 108 is dimensioned to be received in a cylindrical receiving space in the transmission element 84.

The transmission element 84 essentially has an inverted top-hat shape with a cylindrical section 110 forming the cylindrical receiving space and with a circumferential flange section 112.

In addition, as can be seen in FIG. 6, the actuating element 48 has a preloading spring 120 in the form of a compression spring. The preloading spring 120 extends between the counter-bearing element 69 and the upward-facing step at the transition between the upper central region 102 and the central region 104. The preloading spring 120 preloads the actuating element 48 downwardly relative to the guiding and latching unit 46, that is to say in the Stop position as shown in FIG. 6. In this position, for example, the transmission element 84 would, for example, act on a control unit (not shown) to effect a desired function, such as an emergency stop.

As can be seen, the actuating element 48 can be pulled upwards against the preloading of the preloading spring 120 until the ball elements 68 bear against the reduced outer circumference in the region of the lower central region 106 and thereby deploy a certain latching action. The transmission element 84 here moves with the shaft section 82 in such a way that it acts on the control unit in such a way that a desired function, such as a start-up of an installation or another function, can in turn be carried out. The latching action applied by the ball elements is greater than the force applied by the preloading spring 120 so that the actuator would remain in this position (also referred to as an On position). However, even a small downward movement of the actuating element 48 would already suffice to overcome the latching action. As soon as the latching action is eliminated, the actuating element 48 would be moved by the preloading spring 120 into the position shown in FIG. 6.

In addition, a bellows seal 130 can also be seen in FIG. 6. A lower end of the bellows seal 130 is received and clamped between the upper surface of the flange 72 of the outer cylindrical region 70 and an underside of the base 4 of the protective collar 1. A vertically extending part 134 of the bellows seal 130 is guided by a section of the outer cylindrical region 70 lying above the flange 72 into and partially through the central opening 12 in the protective collar 1. To the part 134 is attached a bellows part 136, the upper end of which can be clamped between the plate element 90 of the head unit 80 and the cover 88 (in the region of the recess in the plate element 90). As is evident, the bellows seal 130 can prevent entry of water into an inner region of the actuating element, which takes the form of an emergency stop switch 2.

When the combination of protective collar 1 and actuating element 2 is mounted on a housing 40 of a switching unit in the manner shown in FIG. 6, the protective collar 1 surrounds the actuating element 2. In this case, the actuating element is at least partially protected, in particular against lateral influences and unintended actuation, without actuation of the same being substantially impeded.

By means of the cut-outs 16, the actuating element 2, although surrounded by the protective collar, can be grasped by the head section and pulled upwards, for example, out of the position shown in FIG. 6 (Stop position) into the On position (not shown) where it is held by the latching action of the ball elements 68. From the On position, the actuating element 2 can be easily actuated, for example, by a blow with the heel of the hand, since only a small initial movement is necessary to overcome the latching action. The actuating element 2 then automatically moves into the Stop position (or also the Off position) as shown in FIG. 6, assisted by the preloading spring 120. Impact forces which are applied to the actuating element 48 and usually then also to the protective collar 1 are absorbed by the slots 20 in the wings 18 of the protective collar. As a result, forces acting on the housing 40 can be reduced. In addition, the regions of the wings 18 in the extension of the slots 20 can be designed as predetermined breaking points 21 so that above a predetermined force the protective collar 1 will break here in order to prevent a transmission of force onto the housing 40 and thus possibly to damage the same. The widening shape of the protective collar 1, which is formed by the inclined extension of the wings 18, can also promote a sprung deflection of the wings 18, in particular also in combination with the groove in the base, so that, for example, impact forces are absorbed in the protective collar 1 and are not fully passed on to the housing 40.

When the actuating element 2 is in the Stop position (or also in the Off position) as shown in FIG. 6, a latching element such as a latching bolt or a shackle of a shackle lock (not shown) can be passed through the through-openings 22 and secured against unauthorized removal with a lock, for example. Such a latching element would then block movement of the actuating element 48 into the On position. If the latching element is not needed, it can be accommodated, for example, in the receiving element 26 adjacent to the upper edge of the wing 18. A corresponding latching element can thus be easily kept ready.

The protective collar 1 therefore offers a number of functions which go beyond a normal protective collar. Although the protective collar has been described in combination with a specific embodiment of an actuating element 2, the protective collar can also be used with differently constructed actuating elements, as one skilled in the art can recognize, wherein it is particularly suitable in combination with an actuating element with linear actuation. The function of the actuating element obviously is also not of decisive importance, and the different actuating positions can also bring about precisely the reverse operations to those shown. For example, the position shown in FIG. 6 may be, for example, an On position. However, the shape of the protective collar can also differ from the shape illustrated, or certain elements can be dispensed with. If a latching of the actuating element 48 is not required, the through-openings 22 and the receiving element 26 can, for example, be dispensed with. In some embodiments, for example, the third collar 10 may be omitted if the actuating element has no projecting fastening unit, such as the fastening unit 44 has. In such a case, the underside of the base 4 can abut flat against a housing, for example. In the light of the above description, various possible variations will become apparent to those skilled in the art and the description is not intended to limit the scope of the invention, which is defined by the following claims.

The invention claimed is:

1. A protective collar for at least partially receiving an actuating element which extends through a housing of a control unit and projects beyond an outer side of the housing, the protective collar comprising:

a base having a central through-opening for passing parts of the actuating element therethrough; and a first circumferential collar radially spaced with respect to the central through-opening and extending from an upper side of the base in a first direction, wherein the first circumferential collar has at least two cut-outs such that the first circumferential collar forms at least two wings; and wherein at least one of the wings has at least one predetermined breaking point extending in the circumferential direction.

2. The protective collar according to claim 1, wherein at least two predetermined breaking points are formed at ends of a slot (20) extending over at least 40% of a width of said at least one of the wings, wherein the slot does not extend as far as the cut-outs, the predetermined breaking points being formed between the ends of the slot and the cut-outs.

3. The protective collar according to claim 1, wherein a plurality of predetermined breaking points are formed by a series of slots or cut-outs linearly arranged in a circumferential direction of said at least one of the wings and extending over at least 40% of a width of said at least one of the wings.

4. The protective collar according to claim 2, wherein the slot is formed centrally in the circumferential direction of said at least one of the wings.

5. The protective collar according to claim 2, wherein the slot extends over at least 70% of the width of said at least one of the wings.

6. The protective collar according to claim 1, wherein the at least one predetermined breaking point is formed at least partially by a groove, which extends in the circumferential direction of said at least one of the wings and is located on an inner circumference and/or on an outer circumference of said at least one of the wings.

7. The protective collar according to claim 1, wherein the at least two wings have at least one corresponding predetermined breaking point.

8. The protective collar according to claim 1, wherein the first circumferential collar extends in an outwardly inclined manner from the upper side of the base so that a space formed between the wings widens away from the base.

9. The protective collar according to claim 8, wherein the first circumferential collar extends at an angle to a plane of the base, between 5° and 15°.

10. The protective collar according to claim 1, wherein the first circumferential collar has a round shape.

11. The protective collar according to claim 1, wherein a through-opening is formed in each of the at least two wings and the through-opening in one of the wings is aligned with the through-opening in the other wing.

12. The protective collar according to claim 11, wherein the through-opening in one of the wings is arranged in the vertical direction of the wing between the at least one predetermined breaking point and a free end of the wing.

13. The protective collar according to claim 1, wherein the at least one wing has a mounting eyelet for a securing element.

14. The protective collar according to claim 1, wherein the protective collar has a second circumferential collar which is arranged radially inside the first circumferential collar, wherein the second circumferential collar surrounds and radially delimits the central through-opening.

15. The protective collar according to claim 14, wherein the second circumferential collar has a height which is less than a height of the at least two wings of the first circumferential collar and which is greater than a height of the first circumferential collar at a lowest point of the cut-outs.

16. The protective collar according to claim 14, wherein a step widening towards an underside of the base is formed on an inner circumference of the central through-opening.

17. The protective collar according to claim 14, further comprising a third circumferential collar extending from an underside of the base and forming below the base a receiving space which has a diameter which is greater than a diameter of the central through-opening.

18. The protective collar according to claim 17, wherein the third circumferential collar has structures on an inner circumference of the third circumferential collar which are suitable for working together with structures on the actuating element or a housing for the actuating element in order to prevent the protective collar from rotating relative to the actuating element or the housing.

19. The protective collar according to claim 18, wherein the structures on the inner circumference of the third circumferential collar make a clamping connection to elements of the actuating element, wherein a plurality of projections evenly spaced apart in the circumferential direction of the inner circumference of the third circumferential collar extend inwardly from the third circumferential collar.

* * * * *